United States Patent [19]

Otsugu et al.

[11] Patent Number: 4,740,404

[45] Date of Patent: Apr. 26, 1988

[54] WATERSTOP

[75] Inventors: Shozo Otsugu; Michiyoshi Terauchi; Hiroharu Sasayama, all of Ageo; Yuji Ishihara, Maebashi; Takashi Kushida, Shiga, all of Japan

[73] Assignee: C. I. Kasei, Co. Ltd., Tokyo, Japan

[21] Appl. No.: 915,738

[22] Filed: Oct. 6, 1986

[30] Foreign Application Priority Data

Oct. 7, 1985 [JP] Japan ..... 60-221877
May 31, 1986 [JP] Japan ..... 61-126701

[51] Int. Cl.[4] ..... B32B 3/14; B32B 27/08; E04C 2/00; E04B 1/62

[52] U.S. Cl. ..... 428/44; 428/47; 428/501; 428/518; 428/913; 404/64; 52/232; 52/396

[58] Field of Search ..... 52/232, 396; 404/64, 404/65; 428/501, 518, 519, 520, 913, 44, 47

[56] References Cited

U.S. PATENT DOCUMENTS

| | | | |
|---|---|---|---|
| 2,834,198 | 5/1958 | Goodman | 72/106 |
| 3,461,781 | 8/1969 | Weiner et al. | 94/18 |
| 4,041,665 | 8/1977 | de Munck | 52/396 |
| 4,287,696 | 9/1981 | Mullen | 52/309.7 |
| 4,366,284 | 12/1982 | Ishido et al. | 524/447 |
| 4,382,999 | 5/1983 | Harima et al. | 428/494 |
| 4,443,019 | 4/1984 | Ishido et al. | 524/447 |
| 4,449,713 | 5/1984 | Ishido et al. | 277/1 |
| 4,558,875 | 12/1985 | Yamji et al. | 277/227 |
| 4,622,784 | 11/1986 | Black et al. | 52/2 |

FOREIGN PATENT DOCUMENTS

| | | | |
|---|---|---|---|
| 0067450 | 5/1980 | Japan | 428/913 |
| 775558 | 5/1957 | United Kingdom | 52/396 |

OTHER PUBLICATIONS

Journal of the American Concrete Industry; Waterstop in Concrete Construction; pp. 84–88; Sep. 1955.

*Primary Examiner*—Nancy A. B. Swisher
*Assistant Examiner*—Patrick J. Ryan
*Attorney, Agent, or Firm*—Hopgood, Calimafde, Kalil, Blaustein & Judlowe

[57] ABSTRACT

The waterstop used to prevent passage or leakage of water through a construction joint of concrete is shaped of a plastic or rubber in the form of a continuous-length belt-like form and provided with a water-swellable rubbery layer on at least a portion, or, for example, along the peripheries of the belt-like form, side-by-side coming into contact with the concrete bodies to serve as a water-tight filling of the joint by being swollen with water. The water-swellable rubbery layer is protected temporarily prior to use with a coating film of an alkali-soluble polymeric material which can at least partially be dissolved away by the alkalinity of the water in the concrete joint. The peripheries of the plastic- or rubber-made belt-like form are preferably in a length-wise bulged form having a bore running therethrough to serve as a stress absorber when the water-swellable rubbery layer is swollen with water. The disclosure also includes a particularly preferred water-swellable rubbery composition formed of a matrix comprising an acrylonitrile-butadiene rubber, polyvinyl chloride resin and chlorinated polyethylene and a dispersed phase of a water-swellable crosslinked polymer.

10 Claims, 5 Drawing Sheets

WATERSTOP

BACKGROUND OF THE INVENTION

The present invention relates to a waterstop which is put in a construction joint of concrete and serves to prevent or bar passage or leakage of water through the joint.

In the prior art, it is known that passage or leakage of water through a construction joint of concrete can be prevented by use of a waterstop which is in a belt-like form of board provided on at least a part thereof with a layer of a water-swellable material. Such a conventional waterstop shaped in a continuous-length belt-like form is shipped from the manufacturer in a roll and transported to the site of construction where the rolled board is unrolled and cut in a length suitable for putting into the concrete joint. A problem frequently encountered in the construction works using such a waterstop is that the water-swellable layer thereof becomes inadvertently swollen with rain water or underground water prior to use in the course of transportation to and storage in the site of construction. Once the water-swellable layer has been prematurely swollen prior to use, the waterstop can be mounted on the concrete joint only with great difficulties or, in some adverse cases, the waterstop can no longer exhibit the proper preventing effect of water leakage through the joint.

SUMMARY OF THE INVENTION

An object of the present invention is therefore to provide a waterstop free from the above described problems and disadvantages of premature swelling of the water-swellable layer by the rain water and underground water prior to use unavoidable in the prior art products. Namely, the waterstop of the invention is not affected by the inadvertent contact with rain water and underground water and exhibits the water-leakage preventing effect by swelling of the water-swellable layer only after the waterstop is embedded in a concrete body.

Thus, the waterstop of the invention is an integral body in the form of a continuous-length belt-like form made of a water-swellable rubbery composition as a whole or, preferably, made of a non-swellable plastic resin or rubber provided on at least a portion of the surface thereof with a layer of a water-swellable rubbery composition, the surface of the layer of the water-swellable rubbery composition being coated with a temporary protecting film of a polymeric material which is at least partially soluble in water having alkalinity.

A preferable cross sectional configuration of the inventive waterstop in the form of a continuous-length belt is that the peripheries of the plastic- or rubbermade belt are bulged length-wise and each of the bulged peripheries of the belt is provided with a bore running therethrough and optionally filled with a porous cushioning material to serve as a stress absorber when the water-swellable rubbery layer formed along the outer surface of the bored periphery is swollen with water.

DETAILED DESCRIPTION OF THE PREFERRED EMBODIMENTS

As is understood from the above given summary of the invention, the most characteristic feature of the inventive waterstop is that the layer of the water-swellable rubbery composition is temporarily protected with a water-shielding film made of an alkali-soluble polymeric material so that the waterstop is prevented from premature swelling of the water-swellable rubbery layer by inadvertently contacting with rain water or underground water while the water-shielding film is at least partially dissolved when it is contacted with water having alkalinity in a concrete body in which the waterstop is embedded to have the water-swellable rubbery layer fully swollen with water exhibiting the desired waterstopping effect.

In the following, the waterstop of the invention is described in more detail with reference to the accompanying drawing.

Figure 1:
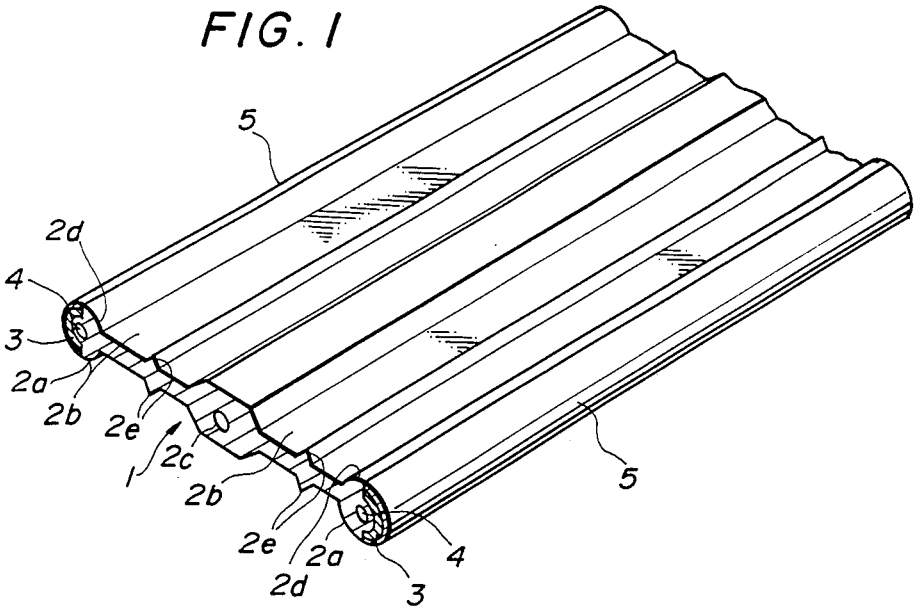
FIG. 1 is a perspective view of a waterstop of the invention showing a transverse cross section and FIG. 2 illustrates a cross section of the same on use as embedded in concrete bodies at a joint.
Figure 2:
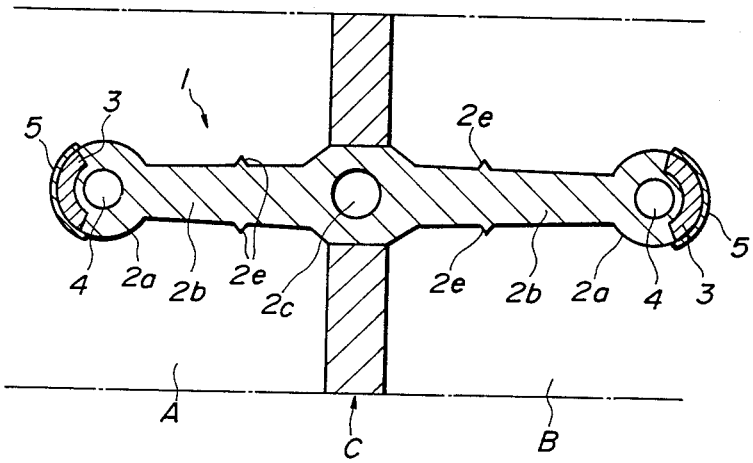

FIGS. 1 and 2 each illustrate a perspective view of a waterstop of the invention showing a transverse cross section and a cross section thereof on use as embedded in concrete bodies at a joint, respectively. The waterstop 1 of the invention is shaped as a whole in a continuous-length belt-like form made of a board base 2 of a plastic or rubber provided with water-swellable rubbery layers 3,3 elongated along the peripheries *2a,2a* of the board base 2. A typical water-swellable rubbery composition for the layers 3,3 is prepared by dispersing a crosslinked water-swellable polymeric material such as a copolymer of maleic anhydride and isobutylene in the matrix of a non-swellable rubber or plastic resin.

As is illustrated in these figures, the peripheries *2a,2a* of the board base 2 forming the inventive waterstop 1 are each shaped to have a cylindrically bulged cross section of a peripheral portion. Each of the cylindrically bulged peripheral portions *2a,2a* is provided with a bore 4 running therethrough in the longitudinal direction to serve as a stress absorber. The outer surface of the cylindrically bulged peripheral portion *2a* is recessed length-wise to form an elongated groove *2d* which is filled with the water-swellable rubbery composition to form the water-swellable layer 3. Another elongated bore *2c* is provided along the center line of the board base 2 and also serves as a stress absorber. Line protrusions 2e are formed somewhere between the center line of the board base 2 and each of the cylindrically bulged peripheral portions *2a,2a* on both sides of the right and left wings *2b,2b* so as to give a corrugated appearance to the waterstop 1. It is of course that the cross section of each of the stress-absorbing bores 4,4,2c is not limited to a circular form but may have a rectangular, elliptical or other form according to need. The bores 4,4,2c may optionally be filled with a porous cushioning material with an object to enhance the stress-absorbing effect of the bores.

In the waterstop of the invention, each of the water-swellable rubbery layers 3,3 is coated with an alkali-soluble water-shielding film 5 to give a temporary protection of the water-swellable layer 3. The water-shielding film 5 should be insoluble in neutral water but at least partially soluble in water alkalified by contacting with uncured concrete. Although the water-shielding film may of course be formed of a material insoluble in neutral water but soluble in alkaline water alone, it is preferable in respect of the film-formability, controllability of the water-absorbing velocity from uncured concrete and durability of the water-stopping power that the water-shielding film 5 is formed of a composition comprising a water-insoluble polymeric material such as synthetic resins, natural rubber, synthetic rubbers and the like as the matrix and a material insoluble in neutral water but soluble in alkaline water as the dispersant in the matrix.

The dispersant material insoluble in neutral water but soluble in alkaline water is exemplified by weakly-acidic synthetic polymer electrolytes such as copolymers of a lower olefin or styrene with maleic anhydride, poly(acrylic acid), poly(methacrylic acid), poly(glutamic acid) and the like, and polymers of acrylic or methacrylic acid esters as well as several inorganic compounds such as aluminum phosphate, basic zinc carbonate and the like, of which the polymeric electrolytes such as the copolymers of maleic anhydride are particularly preferred.

The water-insoluble polymeric material forming the matrix of the water-shielding film 5 should preferably have good adhesion to the surface of the water-swellable layer 3 and may be the same one as the rubber or synthetic resin for the water-inswellable board base 2 or water-swellable layer 3. For example, preferred ones include chlorinated polyethylenes, polychloroprenes and nitrile rubbers.

The amount of the dispersant insoluble in neutral water but soluble in alkaline water in the water-insoluble matrix should be in the range from 5 to 150 parts by weight or, preferably, from 10 to 100 parts by weight per 100 parts by weight of the matrix polymer. The thickness of the water-shielding film 5 should be in the range from 5 to 500 μm or, preferably, from 20 to 300 μm although it should be adequately selected in consideration of the solubility behavior and the formulated amount of the dispersant material insoluble in neutral water but soluble in alkaline water. When the thickness is too small, no sufficient effect of temporary protection can be obtained as a matter of course. When the thickness is too large, on the other hand, a too long time would be taken before the water-swellable layer 3 is brought into contact with water to be swollen and exhibit the water-stopping power.

In the above description, the expression of neutrality of water should not be construed to mean a pH value of exactly 7 but the alkali-soluble dispersant should not be affected by a slightly alkaline water sometimes encountered in natural water in the construction sites. The alkalinity in the above description means an alkalinity which the water content in uncured concrete may have. For example, an alkalinity of a pH value of 13.5 to 13.8 is exhibited by an uncured concrete in which a portland cement containing about 0.5 to 1.0% of total alkali is mixed with water in a 2:1 ratio.

The water-shielding film 5 on the waterstop can be formed in various known methods. For example, the uncoated waterstop is immersed in or spray- or brush-coated with a solution or aqueous emulsion containing the dispersant material soluble in neutral water but soluble in alkaline water followed by drying. The thickness of the water-shielding film 5 can be controlled by modifying the concentration of the film-forming material in the solution or emulsion. In this regard, solutions are preferred to emulsions. Alternatively, the techniques of ternary coextrusion is applicable. Namely, the water-inswellable rubber or plastic resin for the board base 2, the water-swellable polymeric material for the water-swellable layer 3 and the composition for the water-shielding layer 5 are extruded simultaneously into a finished waterstop 1 of the invention.

In the following, a description is given of the manner of using such a waterstop in a construction joint of concrete with reference to FIG. 2. As is illustrated in the figure, the waterstop 1 is embedded in the uncured concrete bodies A and B having a joint gap C in such a disposition as to bridge the concrete bodies A and B in a direction perpendicular to the joint gap C. When water intrudes into the gap C, the water penetrates along the surface of the right and left wings *2b,2b* of the waterstop 1 to reach the cylindrically bulged peripheries *2a,2a*. Since the water has been alkalified in the course of penetration by contacting with the strongly alkaline concrete body A or B, the water reaching the alkali-soluble water-shielding film 5 dissolves the film 5 entirely or at least partially. Accordingly, the water-swellable rubbery layers 3,3 are brought into direct contact with the water so as to be swollen therewith and are firmly and water-tightly pressed against the concrete bodies A and B by the swelling pressure to prevent passage or leakage of water through the joint gap C. Even when the degree of swelling of the water-swellable layers 3,3 is excessively large to give a contacting pressure to the concrete bodies A and B larger than necessary to prevent water leakage, the swelling pressure of the water-swellable layer 3 is directed to the bore 4 and the stress caused thereby is readily absorbed by the deformation or collapse of the stress-absorbing bores 4,4 to effectively avoid the danger of stress-cracking in the concrete bodies A and B which may otherwise take place.

When the waterstop of the invention is used in a joint between a pre-cured concrete body and an uncured concrete body freshly put thereon, it is advantageous that the alkali-soluble water-shielding film on the periphery of the wing to be fixed by adhesive bonding or nailing to the pre-cured concrete body should be at least partially dissolved beforehand by applying alkaline water thereto.

Figure 3:
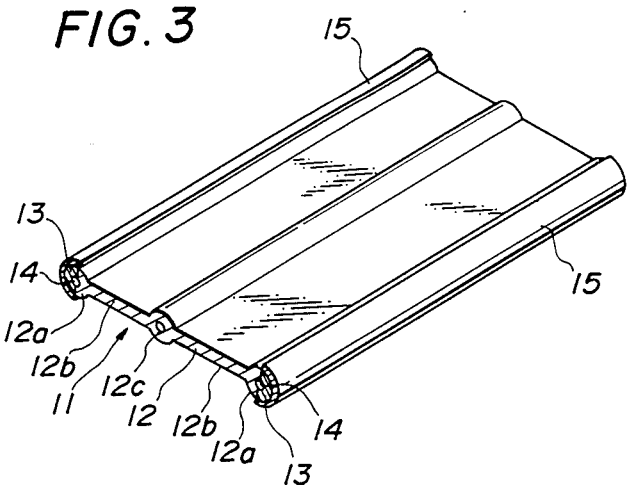
FIG. 3 is a perspective view showing a transverse cross section of a waterstop as another embodiment of the invention and FIG. 4 illustrates a partial cross section of a further different embodiment of the waterstop showing the peripheral portion.
Figure 4:
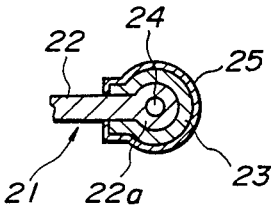

FIG. 3 is a perspective view of a waterstop of the invention similar to that illustrated in FIG. 1. Different from the waterstop 1 illustrated in FIG. 1, the waterstop 11 has the water-swellable rubbery layers 13,13 covering the cylindrically bulged peripheral portions *12a,12a* of the board base 12 over the outer surface having a span of a 180° sector with an overcoating 15 of the alkali-soluble water-shielding film. In other respects, the board 11 of this embodiment is similar to that in FIG. 1 including the right and left wings *12b,12b* and the stress-absorbing bores 14,14 running through the cylindrically bulged peripheral portions *12a,12a* and a bore *12c* running along the center line. The surface surrounding the bore 14 is formed partly of the board base 12 and partly of the water-swellable rubbery layer 13. FIG. 4 illustrates a further modified waterstop 21 of the invention showing a transverse cross section only in the portion including one of the cylindrically bulged peripheral portions 22*a* at a wing end of the board base 22. In this embodiment, the coverage of the water-swellable rubbery layer 23 extends over the whole outer surface of the cylindrically bulged peripheral portion 22*a* with a stress-absorbing bore 24 and further on to the surfaces of the unbulged flat portion of the board base 22. The alkali-soluble water-shielding film 25 naturally covers all over the outer surface of the water-swellable layer 23 without leaving any uncovered areas including the end surfaces of the layer 24 in contact with the flat portion of the board base 22.

Figure 5A:
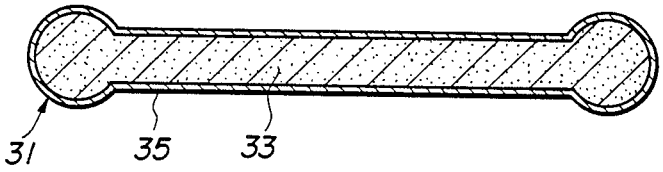
FIGS. 5A to 5J illustrate the transverse cross sections of various modifications of the waterstop according to the invention.
Figure 5B:
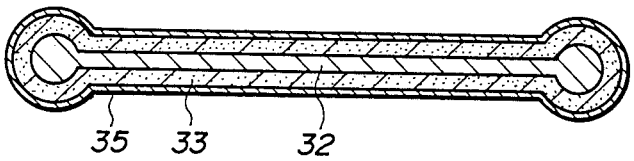
Figure 5C:
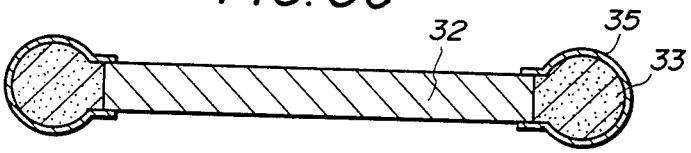
Figure 5D:
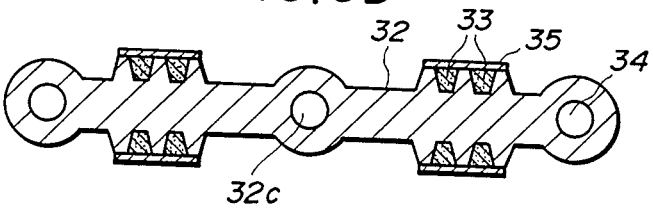
Figure 5E:
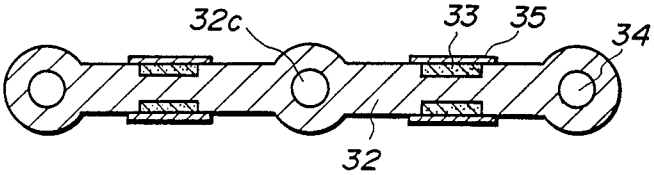
Figure 5F:
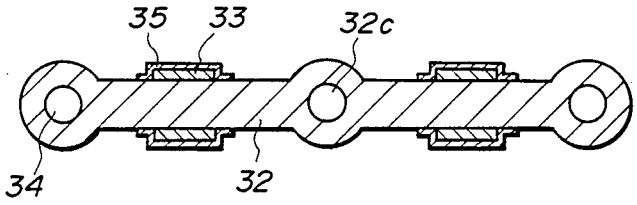
Figure 5G:
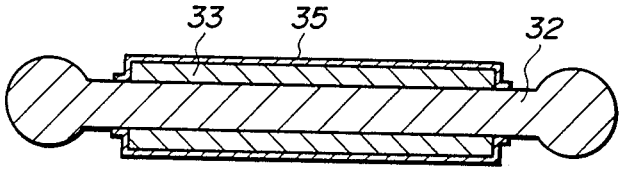
Figure 5H:
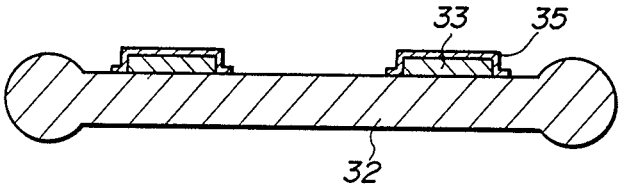
Figure 5I:
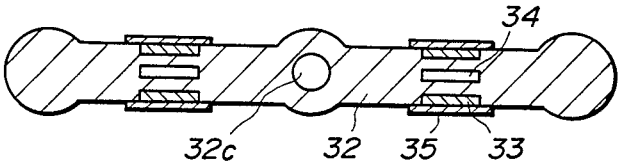
Figure 5J:
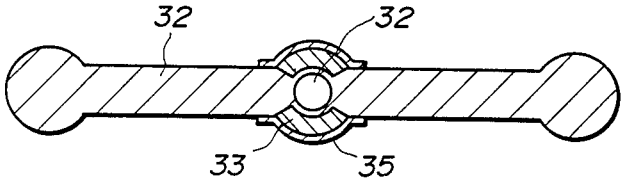

FIGS. 5A to 5J each illustrate a different modification of the waterstop of the invention by a transverse cross section. The waterstop 31 illustrated in FIG. 5A is formed of the water-swellable rubbery material as a whole in the form of a board 33 omitting the board base formed of a non-swellable plastic or rubber. Accordingly, the alkali-soluble water-shielding film 35 entirely envelops the board 33 made of the water-swellable rubbery composition. FIG. 5B illustrates a modified model of the waterstop in FIG. 5A, in which the board base 32 made of a non-swellable plastic or rubber as a core is covered allover the surface with a layer of the water-swellable rubbery composition 33 and an alkali-soluble water-shielding film 35. The other models illustrated in FIGS. 5C to 5J need not be explained any further since the reference numerals correspond to those in FIGS. 1 to 4 including the board base 32, stress-absorbing bore 32*c* along the center line, water-swellable rubbery layer 33, stress-absorbing bore 34 running through the cylindrically bulged peripheral portion of the board base 32 and alkali-soluble water-shielding film 35 covering the surface of the water-swellable layer 33.

Following are several examples of combination of the materials forming (a) the non-swellable board base, (b) the water-swellable rubbery layer and (c) the alkali-soluble water-shielding film, in which "parts" refers to "parts by weight". The combinations I and II are each a formulation for the preparation of a waterstop by coextrusion and the combination III is a formulation for providing the water-shielding film by coating with the solution.

I. (a) 100 parts of a chlorinated polyethylene admixed with 1.5 parts of a stabilizer (b) a blend of 85 parts of a chlorinated polyethylene, 15 parts of a polyisobutylene and 20 parts of a highly water-absorbing crosslinked copolymer of maleic anhydride and isobutylene admixed with 1.5 parts of a stabilizer (c) a blend of 65 parts of a chlorinated polyethylene, 35 parts of a polyisobutylene, 30 parts of dioctyl sebacate and 100 parts of an alkali-soluble copolymer of maleic anhydride and isobutylene admixed with 1.5 parts of a stabilizer II. (a) a blend of 50 parts of a chlorinated polyethylene and a plasticized polyvinyl chloride resin composed of 100 parts of a polyvinyl chloride resin and 54 parts of dioctyl phthalate admixed with 1.5 parts of a stabilizer (b) the same blend as I(b)

(c) the same blend as I(c)

III. (a) a plasticized polyvinyl chloride resin composed of 100 parts of a polyvinyl chloride resin and 54 parts of dioctyl phthalate admixed with 1.5 parts of a stabilizer (b) a blend of 100 parts of a thermoplastic nitrile-based elastomer and 60 parts of the same highly water-absorbing resin as in II(b)

(c) the same copolymer of maleic anhydride and isobutylene as in II(c) dissolved in N,N-dimethyl formamide in a concentration of 20%

In connection with the selection of the materials (a), (b) and (c) above exemplified, it is essential that good adhesion can be obtained between the board base (a) and the water-swellable rubbery layer (b) and that the water-swellable rubbery layer (b) should have good swellability in water even at a relatively low temperature. Since the material of the board base is limited to those above mentioned or, in particular, to plasticized polyvinyl chloride resins due to economical reasons, extensive investigations have been undertaken to develop a water-swellable rubbery composition which satisfies the above mentioned requirements. The investigations have led to a conclusion that the requirements for the water-swellable rubbery layer can best be satisfied when the layer is formed of a composition which comprises:

(A) 100 parts by weight of a polymer blend composed of (A-1) from 10 to 35% by weight of a copolymeric rubber of acrylonitrile and butadiene, (A-2) from 40 to 75% by weight of a polyvinyl chloride resin, and (A-3) from 15 to 50% by weight of a chlorinated polyethylene; and (B) from 10 to 100 parts by weight of a water-swellable crosslinked polymer, with optional admixture of a plasticizer in an amount not exceeding 150% by weight based on the polyvinyl chloride resin.

The principle of the above described formulation of the water-swellable rubbery composition is the admixture of a water-swellable basic composition composed of a polyvinyl chloride resin and a water-swellable crosslinked polymer with a chlorinated polyethylene as a swelling aid and an acrylonitrile-butadiene rubber as a swelling moderator at elevated temperatures with optional admixture of a plasticizer.

As is described above, the polymeric matrix of the water-swellable rubbery composition is formed of a ternary polymer blend composed of the above mentioned polymeric components (A-1), (A-2) and (A-3). The acrylonitrile-butadiene copolymeric rubber serves to promote swelling of the composition at low temperatures and suppress excessive swelling of the composition at elevated temperatures so as to impart stability at high temperatures to the composition with an adequately small ratio of the percentages of swelling at low and high temperatures. The amount of this rubber component in the polymeric matrix should be in the range from 10 to 35% by weight. When the amount thereof is too small, no good high temperature stability of the composition can be obtained. When the amount thereof is too large, on the other hand, the water-swellable rubbery composition may lose the high swelling ratio, flexibility and adhesiveness to the board base more or less.

The polyvinyl chloride resin as the component (A-2) in the rubbery composition is used in an amount in the range from 40 to 75% by weight. When the amount thereof is too small, disadvantages are caused in the water-swellable layer relative to decrease in the function of expansion and mechanical strength as well as in the adhesiveness to the board base. When the amount thereof is too large, on the other hand, the water-swellable rubbery layer may suffer decrease in the adaptability to the changes possibly taking place in the concrete body after setting to affect the performance of water-leakage prevention.

The polyvinyl chloride resin suitable as the component (A-2) is not limited to homopolymeric polyvinyl chloride resins but may be any of vinyl chloride-based resins including, for example, copolymers mainly composed of vinyl chloride and graft polymers obtained by the graft-polymerization of vinyl chloride on to a base polymer such as polyurethanes, chlorinated polyethylenes, copolymers of ethylene and vinyl acetate and the like. Particularly preferable is a graft polymer of vinyl chloride on a polyurethane in respect of the adhesion of the rubbery composition to the board base as well as the mechanical strength and flexibility of the water-swollen rubbery layer.

The third component in the polymer blend for the matrix of the rubbery composition is a chlorinated polyethylene which serves as a swelling aid to moderate the swelling behavior of the composition as well as to improve the adhesion between the water-swollen rubbery layer and the concrete body and to effectively prevent cracking of the concrete body consequently contributing to the improvement in the performance of the inventive waterstop for water-leakage prevention. The amount thereof in the polymer blend should be in the range from 15 to 50% by weight. When the amount is too small, the above mentioned advantageous effects can be obtained only insufficiently as a matter of course. When the amount is too large, on the other hand, the rubbery composition may suffer decrease in the function of expansion and mechanical strength of the layer after swelling.

The water-swellable rubbery composition is composed of the above described polymer blend as the matrix and a dispersed phase therein formed of a water-swellable crosslinked or gelled polymer. Various kinds of known water-swellable crosslinked polymers can be used for the purpose including, for example, crosslinked copolymers of maleic anhydride and isobutylene which can be prepared according to the procedure described in Japanese patent Kokai No. 57-73007. Further, crosslinked (co)polymers based on an unsaturated carboxylic acid are suitable for the purpose such as crosslinked salts of poly(acrylic acid), crosslinked salts of a copolymer of vinyl alcohol and acrylic acid and the like. The amount of the water-swellable crosslinked polymer in the rubbery composition should be in the range from 10 to 100 parts by weight per 100 parts by weight of the ternary polymer blend as the matrix. When the amount thereof is too small, the water-swellable rubbery composition cannot be imparted with sufficiently high water-swellability to decrease the water-leakage preventing effect of the inventive waterstop while, when the amount thereof is too large, the rubbery composition may suffer decrease in the mechanical strength and moldability.

The water-swellable rubbery composition described above may optionally be admixed with a plasticizer in an amount not exceeding 150% by weight based on the content of the polyvinyl chloride resin in the ternary polymer blend.

The water-swellable rubbery composition described above may optionally be admixed with a plasticizer in an amount not exceeding 150% by weight based on the content of the polyvinyl chloride resin in the ternary polymer blend. Suitable plasticizers are exemplified by dioctyl phthalate, diisodecyl phthalate, butyl lauryl phthalate, dioctyl adipate, diisodecyl adipate, dioctyl azelate, dioctyl sebacate and the like. These plasticizers can be used either singly or as a combination of two kinds or more according to need. The formulation of a plasticizer in the water-swellable rubbery composition has an effect to improve the expansion and flexibility of the water-swellable rubbery layer although an excessively large amount may adversely affect the mechanical strength of the water-swellable rubbery layer with consequent decrease in the water-leakage preventing effect.

When adequately formulated within the above described ranges of the amounts of the respective components, the water-swellable rubbery layer formed of the composition may exhibit 1000% or less of volume expansion by swelling in water at 35° C. with at least one third of the ratio of the volume expansion in water at 5° C. to the volume expansion in water at 35° C.

The water-swellable rubbery composition for the inventive waterstop may optionally be admixed, in addition to the above described components, with small amounts of various kinds of additives including rubbery polymers such as polyisobutylene and stabilizers, lubricants, pigments and other additives conventionally used in polyvinyl chloride-based materials according to need.

In the following, examples are given to illustrate the inventive waterstop in detail including the description of the above described newly developed water-swellable rubbery compositions.

EXAMPLE 1

Five water-swellable rubbery compositions No. 1 to No. 5 were prepared each according to the formulation indicated in Table 1 below in parts by weight, each of the components appearing in the table being characterized as follows.

Polyvinyl chloride resin A: a homopolymeric polyvinyl chloride having an average degree of polymerization of about 1050, Geon 103EP, a product by Nippon Zeon Co.

Polyvinyl chloride resin B: a graft polymer of vinyl chloride on a polyurethane, GC#4130, a product by Denki Kagaku Kogyo Co.

Acrylonitrile-butadiene rubber: a copolymeric rubber of acrylonitrile and butadiene, Nipol HF21, a product by Nippon Zeon Co.

Chlorinated polyethylene: Daisolac RA 135, a product by Osaka Soda Co.

Polyisobutylene: Vistanex MML-80, a product by Exxon Chemical Co.

DOP: dioctyl phthalate

DIDP: diisodecyl phthalate

DOS: dioctyl sebacate

Water-swellable gel A: a crosslinked copolymer of maleic anhydride and isobutylene, KI Gel 201, a product by Kuraray Isoprene Chemical Co.

Water-swellable gel B: a salt of vinyl alcohol-acrylic acid copolymer, Sumika Gel SP-520, a product by Sumitomo Kagaku Kogyo Co.

TABLE 1

| | Composition No. | | | | |
|---|---|---|---|---|---|
| | 1 | 2 | 3 | 4 | 5 |
| Polyvinyl chloride resin A | 50 | 50 | — | 100 | 50 |
| Polyvinyl chloride resin B | — | — | 50 | — | — |

TABLE 1-continued

| | Composition No. | | | | |
|---|---|---|---|---|---|
| | 1 | 2 | 3 | 4 | 5 |
| Acrylonitrile-butadiene rubber | 25 | 25 | 17 | — | — |
| Chlorinated polyethylene | 25 | 25 | 25 | — | 50 |
| Polyisobutylene | — | — | 8 | — | — |
| DOP | 50 | — | 25 | 100 | 50 |
| DIDP | — | 40 | — | — | — |
| DOS | — | 15 | — | — | — |
| Water-swellable gel A | 40 | — | 40 | 40 | 40 |
| Water-swellable gel B | — | 40 | — | — | — |
| Lead-containing stabilizer | 2 | 2 | 2 | 2 | 2 |
| Volume expansion at 5° C., % | 410 | 480 | 520 | 100 | 620 |
| 20° C., % | 620 | 590 | 640 | 120 | 1750 |
| 35° C., % | 720 | 700 | 750 | 170 | 3200 |
| Hardness, prior to swelling | 62 | 62 | 58 | 58 | 60 |
| Hardness, after 200% swelling | 40 | 40 | 20 | — | 40 |

Each of the compositions was shaped by extrusion molding into a sheet having a thickness of 2 mm, from which test pieces of 20 mm wide and 100 mm long were prepared by cutting. The test pieces were dipped for 7 days in baths of city water at 5° C., 20° C. and 35° C. to determine the volume expansion in % by swelling to give the results shown in Table 1 which also shows the hardness of the test pieces prior to swelling and the hardness of the same when it was swollen by 200%. The values of hardness are in the JIS A scale.

As is shown by the results in Table 1, the volume expansion of the compositions No. 1 to No. 3 compounded with the acrylonitrile-butadiene rubber was within an adequate range of 400 to 500% at 5° C. and about 700% at 35° C. while the composition No. 4 exhibited only smaller than 200% of volume expansion by swelling even at 35° C. and the volume expansion of the composition No. 5 was 3000% or even larger at 35° C. indicating that the composition was not suitable for shaping the water-swellable rubbery layer of the inventive waterstop.

EXAMPLE 2

Two types of waterstops I and II were prepared each having a cross section illustrated in FIGS. 1 and 2 by the technique of coextrusion. The polymeric compositions for the board bases and the alkali-soluble water-shielding films of these waterstops were in common to these two types while the water-swellable rubbery layers were prepared using different rubbery compositions I and II, respectively. Table 2 below shows the formulations of the polymeric compositions in parts by weight for the board bases, water-swellable rubbery layers in types I and II and alkali-soluble water-shielding films. Isoban 04 used in the formulation of the alkali-soluble water-shielding film is a product by Kuraray Isoprene Chemical Co., which is a copolymer of maleic anhydride and isobutylene. Other ingredients, excepting the calcium carbonate filler, were the same ones as appearing in Table 1.

The adhesive bonding between the board base and the water-swellable rubbery layer was quite satisfactory in each of the waterstops. When the waterstops, from which the alkali-soluble water-shielding film had been removed, were dipped in water at 35° C., however, the water-swellable rubbery layer of the waterstop II was separated from the board base after 5 days of dipping. On the other hand, the adhesive bonding was complete between the board base and the water-swellable rubbery layer of the waterstop II.

TABLE 2

| | Board base | Water-swellable rubbery layer | | Alkali-soluble water-shielding film |
|---|---|---|---|---|
| | | I | II | |
| Polyvinyl chloride resin A | 100 | 56 | 30 | 50 |
| Acrylonitrile-butadiene rubber | — | 22 | 20 | — |
| Chlorinated polyethylene | — | 22 | 50 | 50 |
| DOP | 55 | 56 | — | 50 |
| DIDP | — | — | 25 | — |
| DOS | — | — | 8 | — |
| Water-swellable gel A | — | 40 | 25 | — |
| Lead-containing stabilizer | 3 | 2 | 2 | 2 |
| Heavy calcium carbonate filler | 20 | — | — | — |
| Isoban 04 | — | — | — | 120 |

EXAMPLE 3

A waterstop having a cross section as illustrated in FIGS. 1 and 2 was prepared using a chlorinated polyethylene for the board base, a polymer blend of a chlorinated polyethylene, polyisobutylene and highly water-absorbing crosslinked copolymer of maleic anhydride and isobutylene for the water-swellable rubbery layer and a polymer blend of a chlorinated polyethylene, polyisobutylene, plasticizer and alkali-soluble copolymer of maleic anhydride and isobutylene for the alkali-soluble water-shielding film. The cross section of the waterstop had following dimensions: 100 mm of the overall width; 8 mm of the thickness of the board base 2 in the flat portion 2*b;* 8 mm of the diameter of the central bore 2*c;* 6 mm of the diameter of the peripheral bore 4; 3 mm of the thickness of the water-swellable rubbery layer 3; 15 mm of the outer width of the water-swellable rubbery layer 3; and 0.2 mm of the thickness of the water-shielding film 5.

Figure 6:
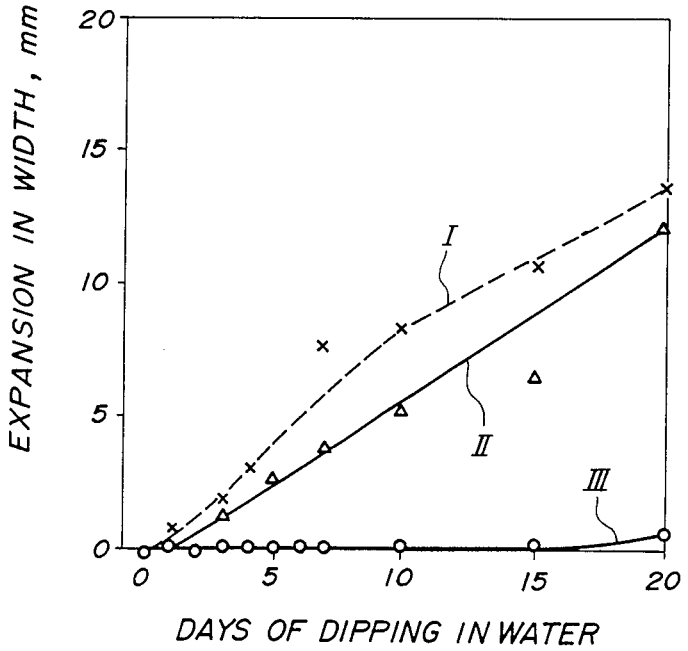
FIG. 6 is a graphic showing of the change in the dimension of a waterstop of the invention as a function of the length of time of dipping in water.

Three test pieces I, II and III were prepared by cutting the thus prepared waterstop of continuous length and they were dipped for days in water at 20° C. after embedding in concrete bodies for 96 hours and 72 hours and without embedding in a concrete body. The overall widths of the waterstop were measured periodically to determine the increment by the swelling of the layer 5 with water. The results are shown in FIG. 6 by the curves I, II and III for the test pieces after 96 hours and 72 hours embedding in concrete bodies and without embedding in a concrete body, respectively. As is understood from the results shown in FIG. 6, the water-swellability of the water-swellable rubbery layers could be exhibited only when the waterstop had been embedded in a concrete body prior to dipping in water. Namely, the water-swellable rubbery layer of the test piece III exhibited little swelling even after 20 days of dipping in water indicating the effectiveness of the alkali-soluble water-shielding film against water-swelling of the water-swellable layer.

EXAMPLE 4

Figure 7:
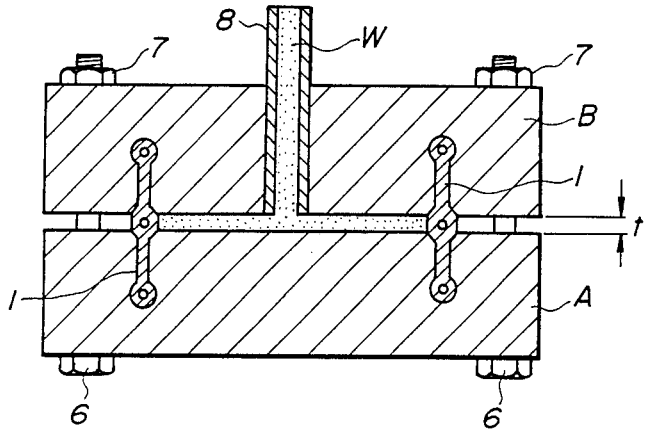
FIG. 7 illustrates the testing assembly of the inventive waterstop by a cross section.

A model test was undertaken for the water-leakage preventing effect of the waterstop prepared in the preceding example. The testing assembly is shown in FIG. 7 by a cross section. Thus, two test pieces 1,1 of the waterstop were each embedded at the lower half thereof in a concrete block A before curing and then another concrete block B was molded above the block A keeping a 10 mm space therebetween under restriction with several sets of bolts 6 and nuts 7 as a simulated construction joint and embedding the upper half of each waterstop board 1. After 7 days of curing of the concrete blocks A and B, water W was pressurized into the space surrounded by the concrete blocks A and B and two waterstops 1,1 through the steel nozzle 8 in such a manner that the width of the joint gap space shown by t in the figure was first increased to 15 mm and 20 mm by untightening the bolts 6 and nuts 7 and then decreased to 10 mm by again tightening the bolts 6 and nuts 7 under a hydraulic pressure varied in the range from 1 to 5 kgf/cm$^2$ to visually examine leakage of water out of the joint. The results obtained using the waterstop prepared in the preceding example were that absolutely no water leakage was found irrespective of the increase and decrease of the gap space t and the hydraulic pressure. When another waterstop prepared in the same manner as in the preceding example without providing the alkali-soluble water-shielding film was used instead for comparative purpose, on the other hand, leakage of water took place by increasing the gap space t to 15 mm under a hydraulic pressure of 4 kgf/cm$^2$ or larger and by subsequently decreasing the gap space t to 10 mm under a hydraulic pressure of 3 kgf/cm$^2$ or larger to give an evidence for the advantageous effect obtained by the alkali-soluble water-shielding film provided according to the invention. The results of this comparative test were presumably due to the fact that the uncured concrete coming into direct contact with the water-swellable rubbery layer of the waterstop was deprived of water or dehydrated to cause poor curing of the concrete due to the deficiency in water.

What is claimed is:

1. A waterstop in an elongated integral form which comprises:

(a) a board base made of a non-swellable polymeric material in a belt-like form;

(b) an elongated swellable layer of a water-swellable rubbery composition integrally formed on at least a part of the outer surface of the board base and extending along the length of the longitudinal periphery of the board base; and (c) a water-shielding film made of a polymeric material at least partly soluble in alkaline water and formed on the surface of the layer of the water-swellable rubber composition.

2. The waterstop as claimed in claim 1 wherein the board base is provided with an elongated bore running therethrough along each of the longitudinal peripheries thereof.

3. A waterstop as claimed in claim 2 wherein the elongated swellable layer of a water-swellable rubbery composition is formed on the surface of the longitudinal periphery of the board base provided with the elongated bore.

4. The waterstop as claimed in claim 1 wherein the water-swellable rubbery composition comprises:

(A) 100 parts by weight of a polymer blend composed of (A-1) from 10 to 35% by weight of a copolymeric rubber of acrylonitrile and butadiene;

(A-2) from 40 to 75% by weight of a polyvinyl chloride resin, and (A-3) from 15 to 50% by weight of a chlorinated polyethylene; and (B) from 10 to 100 parts by weight of a water-swellable crosslinked polymer.

5. The waterstop as claimed in claim 1 wherein the board base is made of a plasticized polyvinyl chloride resin composition.

6. The waterstop as claimed in claim 4 wherein the water-swellable rubbery composition further comprises a plasticizer in an amount not exceeding 150% by weight based on the polyvinyl chloride resin.

7. The waterstop as claimed in claim 4 wherein the water-swellable crosslinked polymer is a crosslinked copolymer of maleic anhydride and isobutylene.

8. The waterstop as claimed in claim 1 wherein the water-shielding film has a thickness ranging from 5 microns to 500 microns, and is partly soluble in water having a pH from about 13.5 to 13.8.

9. A waterstop in an elongated integral form which comprises:

(a) an elongated belt-like board made of a water-swellable rubbery composition; and (b) a water-shielding film made of a polymeric material at least partly soluble in alkaline water and formed on the surface of the belt-like board made of a water-swellable rubbery composition.

10. The waterstop as claimed in claim 9 wherein the water-shielding film has a thickness of 5 microns to 500 microns and is soluble in water having a pH from about 13.5 to 13.8.

* * * * *